US010046886B2

(12) United States Patent
Jian et al.

(10) Patent No.: US 10,046,886 B2
(45) Date of Patent: Aug. 14, 2018

(54) CONTAINER AND LID HANGING STRUCTURE THEREOF

(71) Applicant: SHANGHAI HONGYAN RETURNABLE TRANSIT PACKAGINGS CO., LTD, Shanghai (CN)

(72) Inventors: Yuanli Jian, Shanghai (CN); Yongping Su, Shanghai (CN); Kai Gong, Shanghai (CN)

(73) Assignee: SHANGHAI HONGYAN RETURNABLE TRANSIT PACKAGINGS CO., LTD., Shanghai (CN)

( * ) Notice: Subject to any disclaimer, the term of this patent is extended or adjusted under 35 U.S.C. 154(b) by 0 days.

(21) Appl. No.: 14/422,113

(22) PCT Filed: Aug. 16, 2013

(86) PCT No.: PCT/CN2013/081668
§ 371 (c)(1),
(2) Date: Feb. 17, 2015

(87) PCT Pub. No.: WO2014/026648
PCT Pub. Date: Feb. 20, 2014

(65) Prior Publication Data

US 2015/0239622 A1 Aug. 27, 2015

(30) Foreign Application Priority Data

Aug. 16, 2012 (CN) ..... 2012 1 0292745

(51) Int. Cl.
*B65D 43/20* (2006.01)
*B65D 77/06* (2006.01)
*B65D 19/06* (2006.01)

(52) U.S. Cl.
CPC ..... *B65D 43/20* (2013.01); *B65D 19/06* (2013.01); *B65D 77/061* (2013.01); *B65D 2519/00333* (2013.01); *B65D 2519/00711* (2013.01)

(58) Field of Classification Search
CPC ..... B65D 43/20; B65D 11/18; B65D 43/02; B65D 19/06; B65D 77/061; B65D 2519/00711
(Continued)

(56) References Cited

U.S. PATENT DOCUMENTS 278,563 A * 5/1883 Lane ..... B65D 9/04 217/81
2,071,930 A * 2/1937 Hunter ..... A47B 63/00 109/37
(Continued)

FOREIGN PATENT DOCUMENTS

CN 1340443 3/2002
CN 2732150 10/2005
(Continued)

OTHER PUBLICATIONS

International Search Report for application No. PCT/CN2013/081668, dated Nov. 21, 2013 (5 pages).
(Continued)

*Primary Examiner* — Anthony Stashick
*Assistant Examiner* — Robert Poon
(74) *Attorney, Agent, or Firm* — Hamre, Schumann, Mueller & Larson, P.C.

(57) ABSTRACT

A lid hanging structure of a container is disclosed in the present invention. The container includes a base, side plates and a lid. the hanging structure includes hanging members and hanging slots, wherein the hanging members are engaged or disengaged with the hanging slots respectively
(Continued)

so as to hang the lid on the container or remove the lid from the container, and one of the anging members and the hanging slot is provided on the lid and the other is provided on the side plates. According to the lid hanging structure, it is convenient to remove the lid from the container when necessary. That is to say that, the lid can be removed directly when not in use or in the hanging state, and can be removed by simple operation in the hanging state, so as to reduce the amount of labor, and the structure is simple and the cost is low.

6 Claims, 14 Drawing Sheets

(58) Field of Classification Search
USPC ..... 206/600; 220/379, 811, 813
See application file for complete search history.

(56) References Cited

U.S. PATENT DOCUMENTS 2,661,119 A * 12/1953 Spiess, Jr. ..... B65D 43/20 220/815
3,015,405 A * 1/1962 Sterling ..... B65F 1/1646 217/56
3,961,723 A * 6/1976 Eckel ..... B65D 43/14 220/812
4,320,852 A 3/1982 Nagelkirk
4,448,327 A 5/1984 Gahm
4,453,530 A * 6/1984 Schlosser ..... A47J 37/0786 126/25 R
4,592,483 A * 6/1986 Scouten ..... B65D 39/00 220/379
5,244,108 A * 9/1993 Hale ..... B65D 19/06 206/596
5,564,599 A * 10/1996 Barber ..... B65D 11/1853 206/600
7,066,476 B2 * 6/2006 Elden ..... B62B 1/12 220/379
2003/0102309 A1 * 6/2003 Hartwall ..... B65D 19/18 220/6
2005/0150892 A1 * 7/2005 Miller ..... B65D 19/18 220/324
2006/0012202 A1 1/2006 Sakakibara et al.
2010/0252468 A1 * 10/2010 Pratte ..... A61L 2/26 206/363

FOREIGN PATENT DOCUMENTS

CN 102484088 5/2012
CN 102807028 12/2012
CN 202717140 2/2013
DE 9408039 7/1994
DE 102005008695 A1 * 8/2006 ..... B65D 5/64
DE 102009024081 12/2010
DE 202011108161 U1 * 9/2012 ..... B65D 19/18
EP 2256050 A1 * 12/2010 ..... B65D 19/18
EP 2537769 12/2012
JP 2003-026160 1/2003

OTHER PUBLICATIONS

Chinese Office Action, dated Feb. 7, 2014, Chinese Patent Application 201210292745.0.
Chinese Office Action, dated Jul. 29, 2014, Chinese Patent Application 20121029745.0.
Extended European Search Report for European patent application No. 13829319.6, dated Feb. 11, 2016 (7 pages).

* cited by examiner

CONTAINER AND LID HANGING STRUCTURE THEREOF

FIELD

The present invention relates to a container, in particular to a lid hanging structure of a container.

BACKGROUND

A large container generally has four side plates and a base, and a lid is also provided for a large container used in transport of bulks or liquids so as to protect the cargo inside the container. There is provided an edgeguard around the lid close to the outer sides of the four side plates. When the cargo inside the container applies a large force against the four side plates, to a certain extent the edgeguard of the lid will prevent the four side plates from deforming too large. Further, when the liquids or bulks inside the container fluctuate upwardly, the lid will limit the fluctuating of a liner containing the liquids or bulks, thus preventing the liner from being damaged. However, due to the large length and width dimensions of the container (most of them are larger than 1 m), the volume of the lid is also huge and the weight of the lid is often more than 5 kg, which results that it is difficult to open or remove the lid.

A method to open a lid by sliding was disclosed in Patent DE102009024081A1. In the patent, a set of hinges which are connected to the fixed part of a bearing sleeve are mounted at the upper of a side plate, and the lid is connected to the movable portion of the bearing sleeve. When the lid is opened by a certain angle from the opposite side of the side plate, the bearing sleeve is rotated by a corresponding angle around the hinges. Then, the lid will be moved stably due to the support of the bearing sleeve when the lid is pushed forward further. When the lid is moved to the end of the bearing sleeve, the lid will be rotated outward around the hinges and thus is hung on the side plate.

To a certain extent using the above method can avoid the transfer of the lid and reduce the amount of labor. However, it is not convenient to install and uninstall the lid due to its complicated structure. Further, the cost of components of the container is high. In addition, the lid which is not easy to be detached appears to be inconvenient when cleaning the container.

Thus, a lid hanging structure of a container which has simple structure and is convenient to use is needed.

SUMMARY

The aim of the present invention is to provide a lid hanging structure of a container which have simple structure and is installed or uninstalled conveniently.

In order to achieve the above aim, a lid hanging structure of a container which includes a base, side plates and a lid is disclosed. said hanging structure includes hanging members and hanging slots, wherein the hanging members are engaged or disengaged with the hanging slots respectively so as to hang the lid on the side plates or remove the lid from the side plates; and one of the hanging member and the hanging slot is provided on the lid and the other is provided on the side plates.

In a preferred embodiment of the present invention, said hanging member is a bearing pin provided on the side plate and said hanging slot is provided on the lid, wherein the lid can slide along the side plates and is hung on the side plates through the engagement of the bearing pin and the hanging slot.

In the above preferred embodiment, preferably, pits are provided on both ends of the upper portion of the side plates of the container respectively, and the bearing pins are projected from a side walls of the pits respectively, wherein the bearing pin will enter into the hanging slot after the lid sliding by a distances along the side plates so that the lid is hung on the side plates.

In the above preferred embodiment, preferably, ribs are provided on the lid so as to reduce friction during the process of the sliding of the lid, and the slot is provided with a guide slope so as to guide the bearing pin into the hanging slot.

In another preferred embodiment of the present invention, the hanging members are bearing pins provided on the lid and the hanging slots comprising a pit and a guide slope are provide on both ends of the upper portion of the side plates respectively, wherein the bearing pins will enter into the pits through the guide slope when the lid slides on the side plates.

In the above preferred embodiment, preferably, ribs are provided on the lid so as to reduce friction during the process of the sliding of the lid.

Another lid hanging structure of a container is also disclosed in the present invention. the container includes a base, side plates and a lid and said hanging structure includes hanging members and hanging slots, wherein the hanging members are engaged or disengaged with the hanging slots respectively so as to hang the lid on the side plates or remove the lid from the side plates; and said hanging members are separate members which will be installed on the side plates when in use.

In a preferred embodiment of the present invention, the hanging slots are provided on the lid and mating structures for engaging with the hanging member and the lid are provided on the side plates, wherein the mating structures enable the lid to engage with the hanging members so as to open or close the lid or hang the lid on the side plates.

In the above preferred embodiment, the hanging member comprises a rotation pin, a bearing pin, and two position limiting pins, wherein one of the position limiting pins is further provided with a projection and a torsional spring is provided on the bearing member; the mating structure comprises pits on both ends of upper portion of the side plates, wherein a circular hole, a special-shaped through-hole with a special arced contour, and a position limiting hole are provided at each pit; wherein the rotation pin is inserted into the circular hole and the two position limiting pins are inserted into the circular hole and the special-shaped through-hole respectively so as to keep the hanging member on the mating structure when the bearing pins are installed on the side plates; and the bearing pin will be engaged or disengaged with the hanging slot so as to hang or remove the lid.

A container which includes a base, side plates and a lid is also disclosed in the present invention, wherein the container further comprises the lid hanging structure according to the above embodiments.

According to the lid hanging structure, it is convenient to remove the lid from the side plates when necessary. That is to say that, the lid can be removed directly when not in use or in the hanging state, and can be removed by simple operation in the hanging state, so as to reduce the amount of labor, and the structure is simple and the cost is low.

DRAWINGS

Figure 3A:
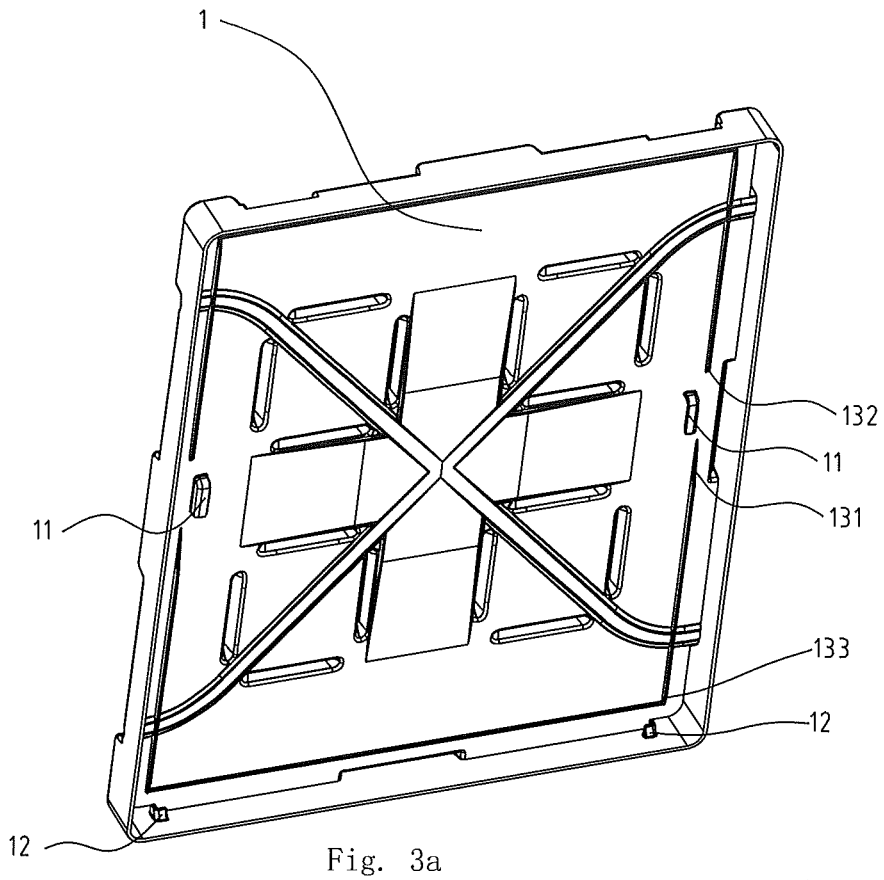
Figure 3B:
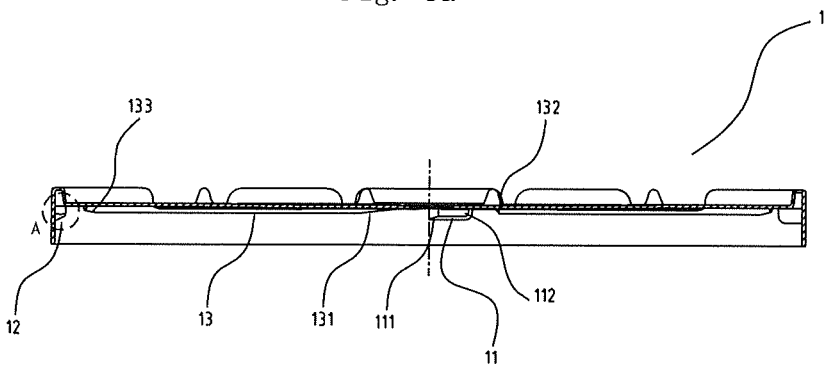
Figure 3C:
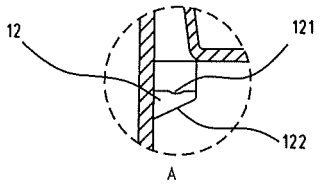

FIG. 3*a* shows a perspective structural view of the lid provided with the lid hanging structure according to the first embodiment of the present invention;

FIG. 3*b* shows a cross-sectional view of the lid provided with the lid hanging structure according to the first embodiment of the present invention;

FIG. 3*c* shows an enlarged view of part A of the lid in FIG. 3*b;*

Figure 4:
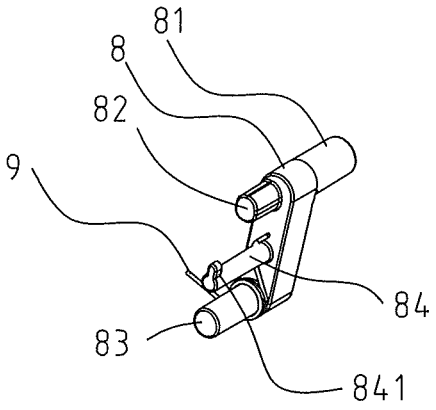
Figure 5A:
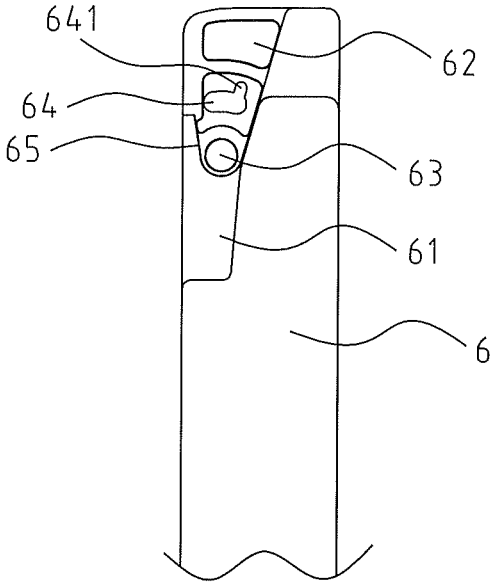
Figure 5B:
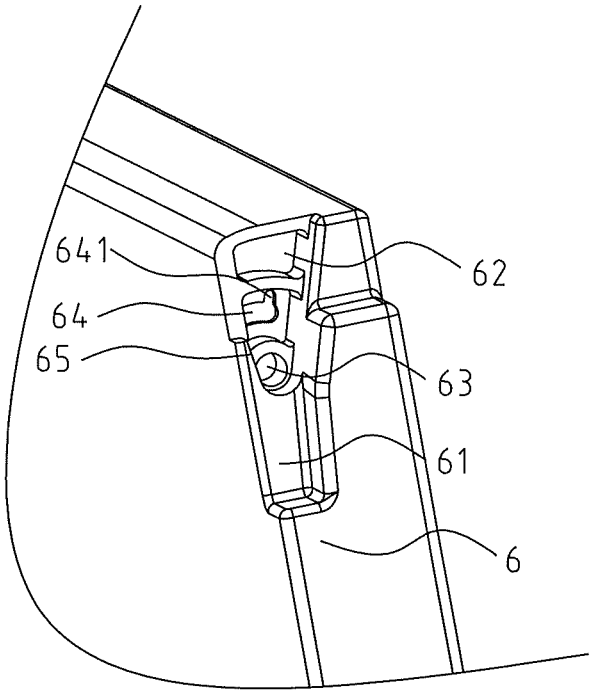

FIG. 4 shows a perspective view of a hanging member of the lid hanging structure according to the first embodiment of the present invention;

FIG. 5*a* shows a front view of a mating structure of the lid hanging structure provided on the upper portion of the side plate according to the first embodiment of the present invention;

FIG. 5*b* is an enlarged view of the mating structure in FIG. 5*a;*

Figures 6A, 6B, 6C:
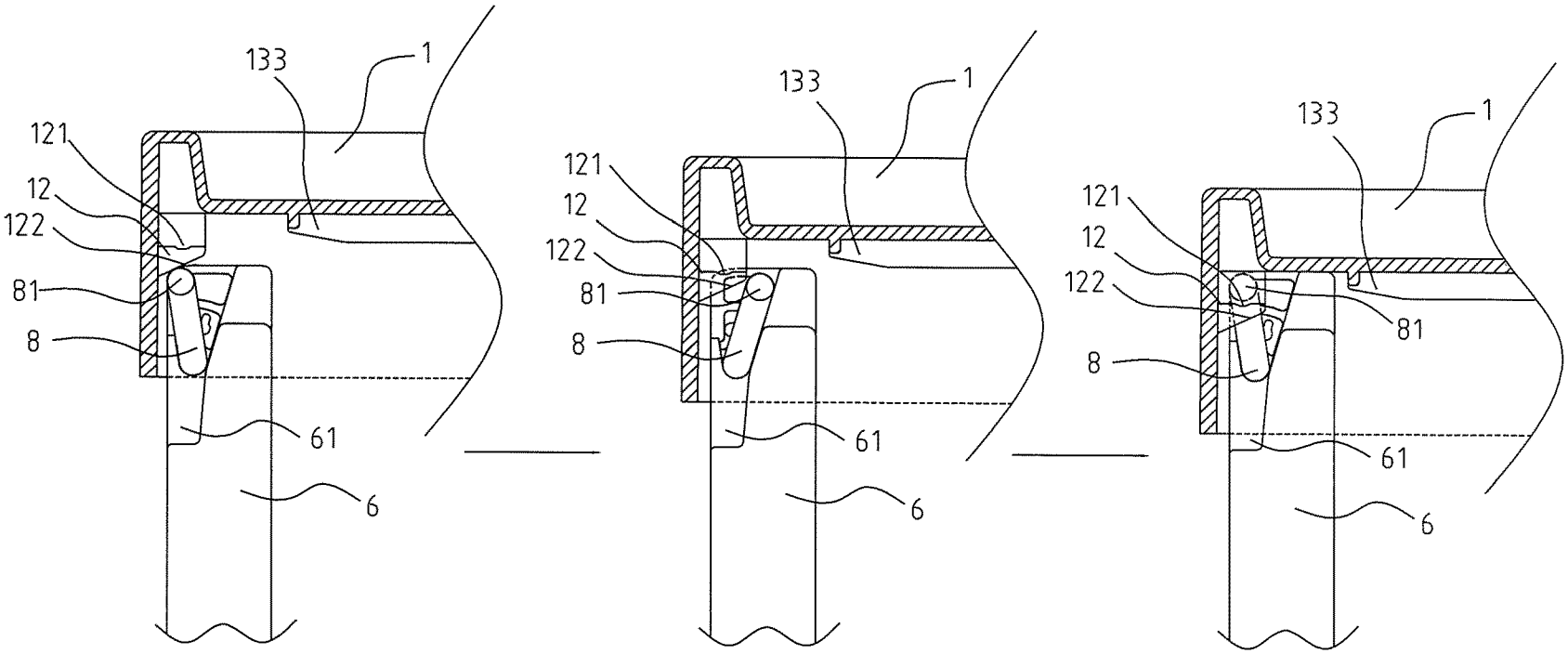
Figure 12:
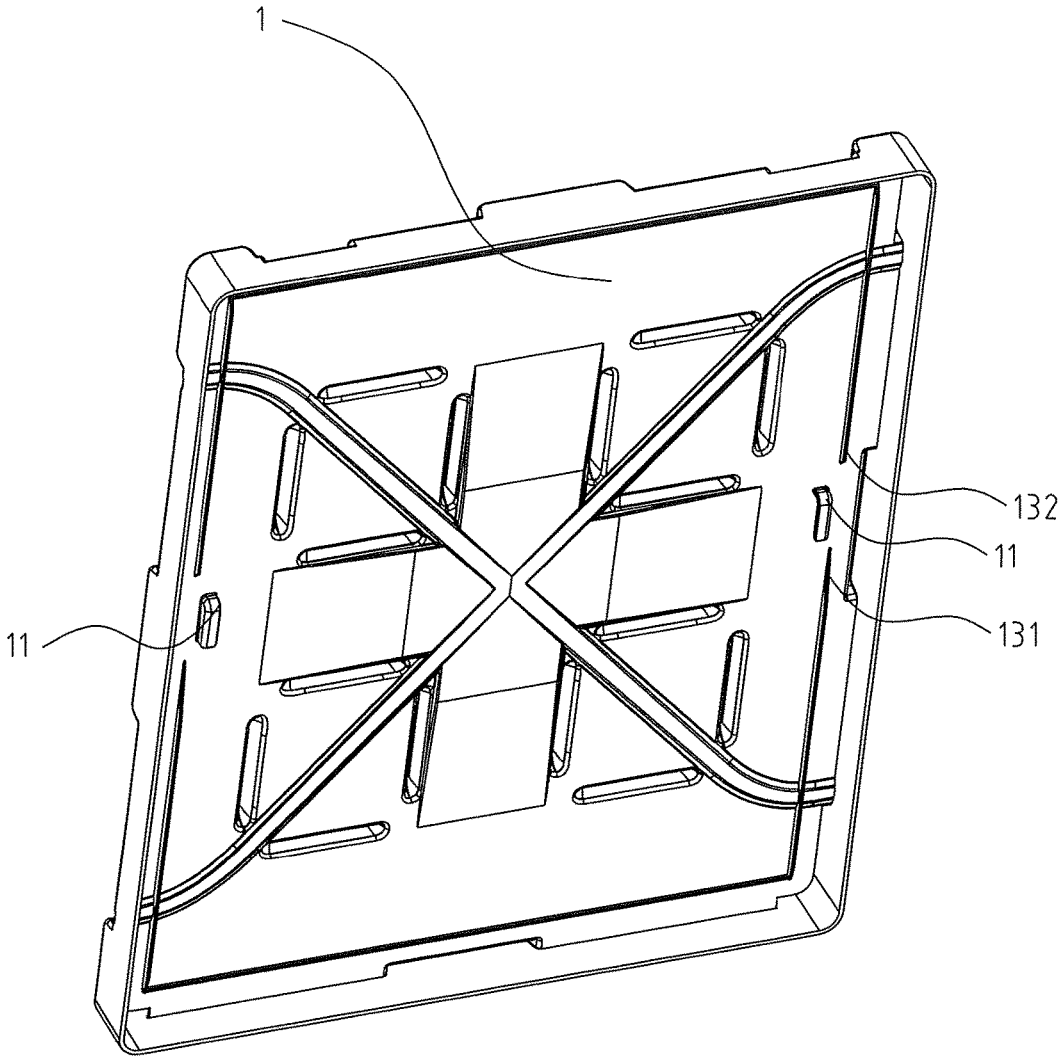
Figure 13A:
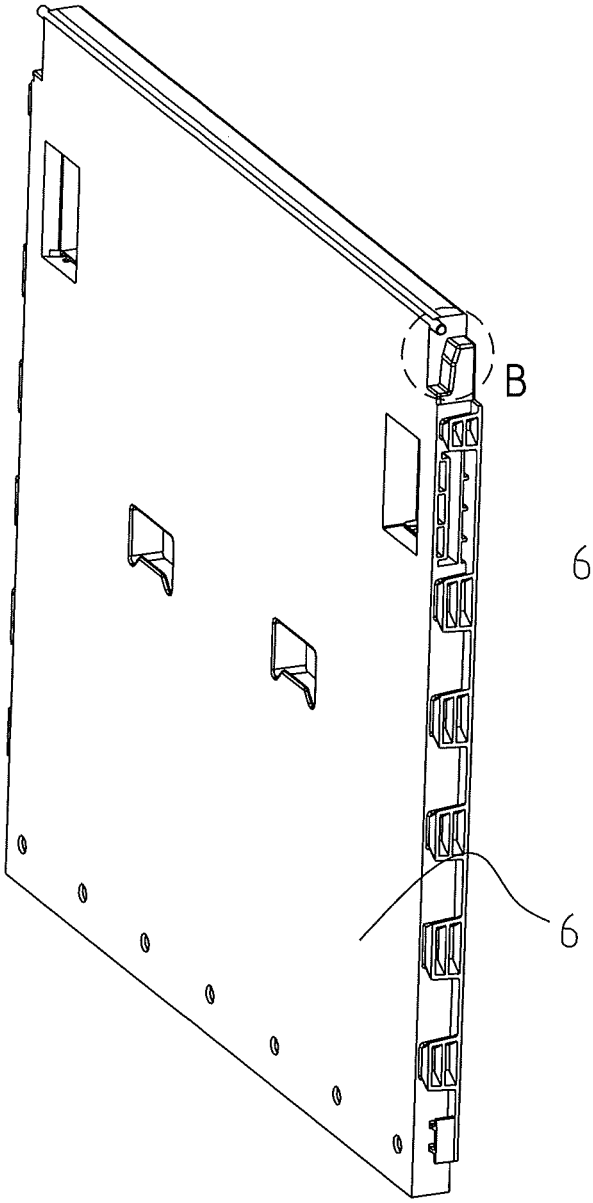
Figure 13B:
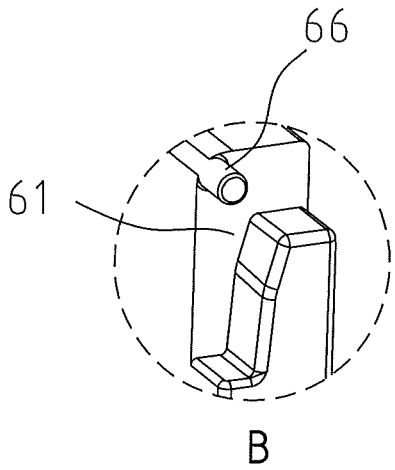

FIG. 6*a*-6*c* shows the process of the hanging member entering into a slot of a lid when the lid is placed on the side plates from directly above the side plates according to the first embodiment of the present invention;

FIGS. 7-11 show the process of the lid being moved from using state to hanging state according to the first embodiment of the present invention;

FIG. 12 shows a structural perspective view of a lid provided with the lid hanging structure according to the second embodiment of the present invention;

FIG. 13*a* shows a front view of a mating structure of the lid hanging structure provided on the upper portion of a side plate according to the second embodiment of the present invention;

FIG. 13*b* shows an enlarged view of part B of the side plate in FIG. 13*a;*

Figure 14:
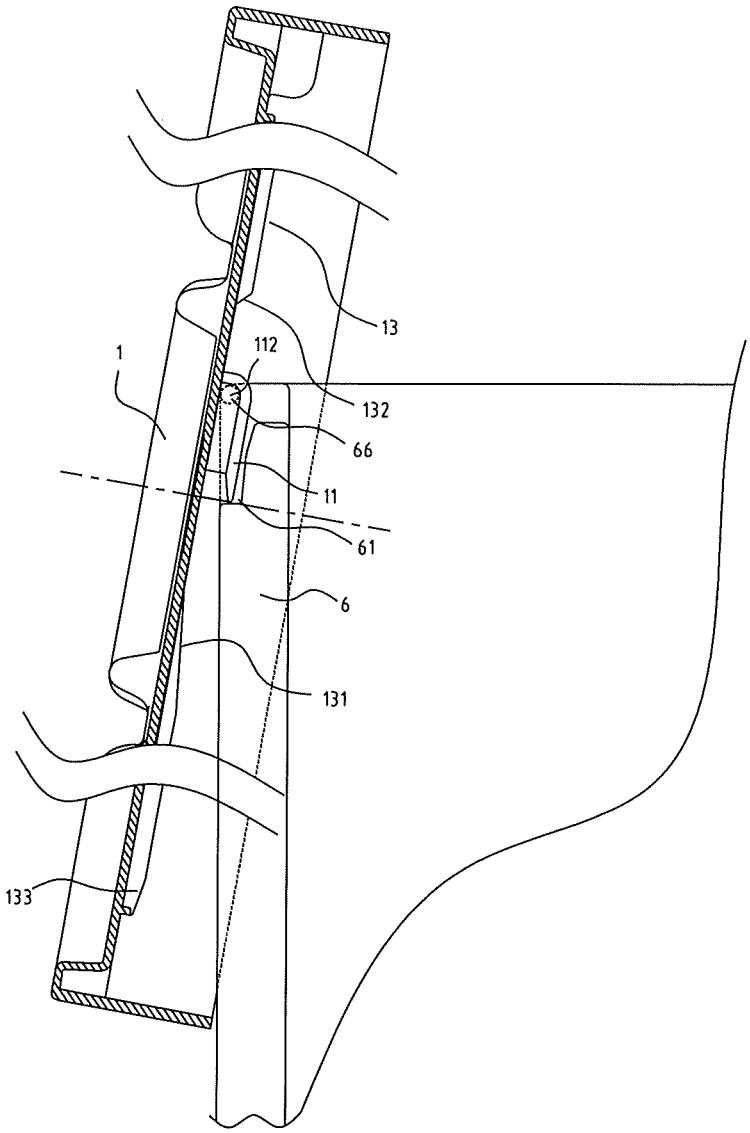
Figure 15:
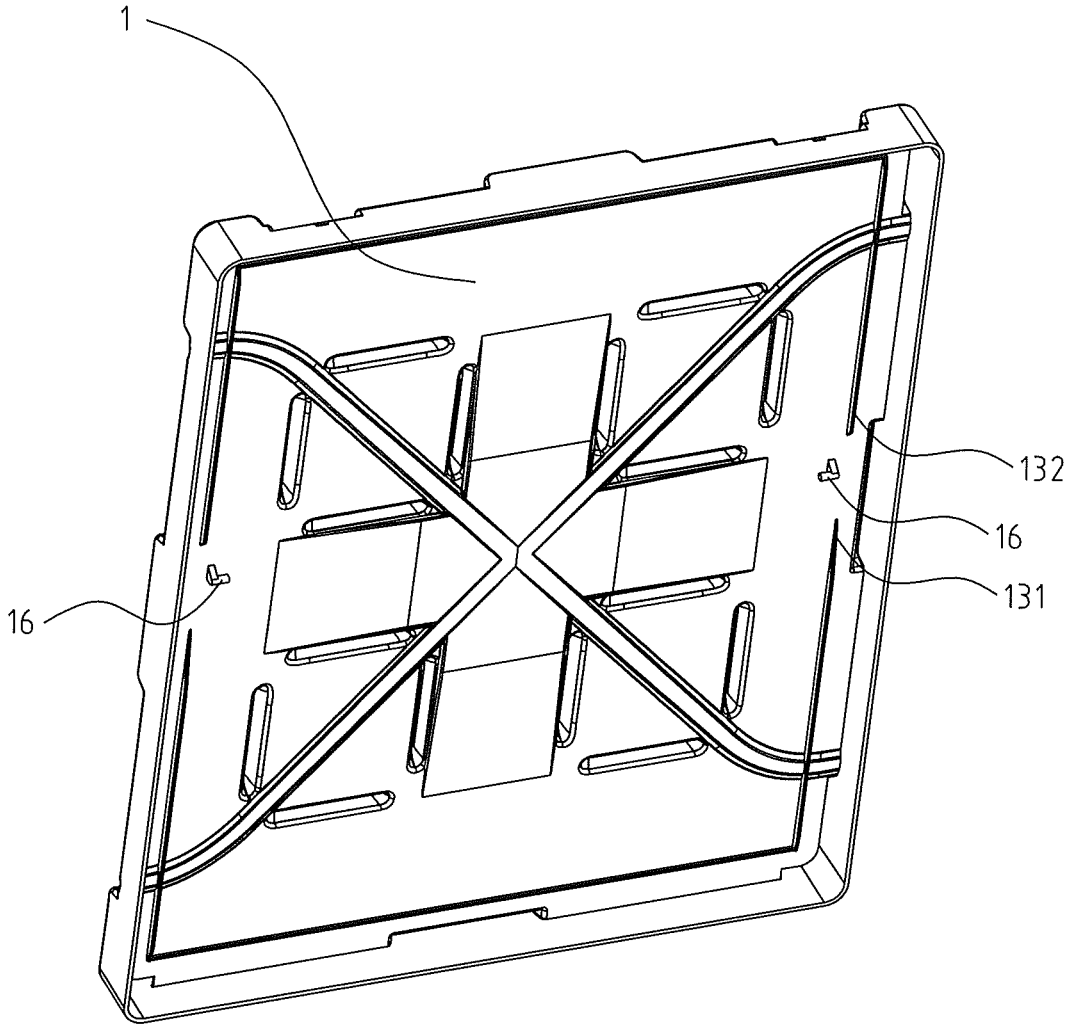
Figure 16A:
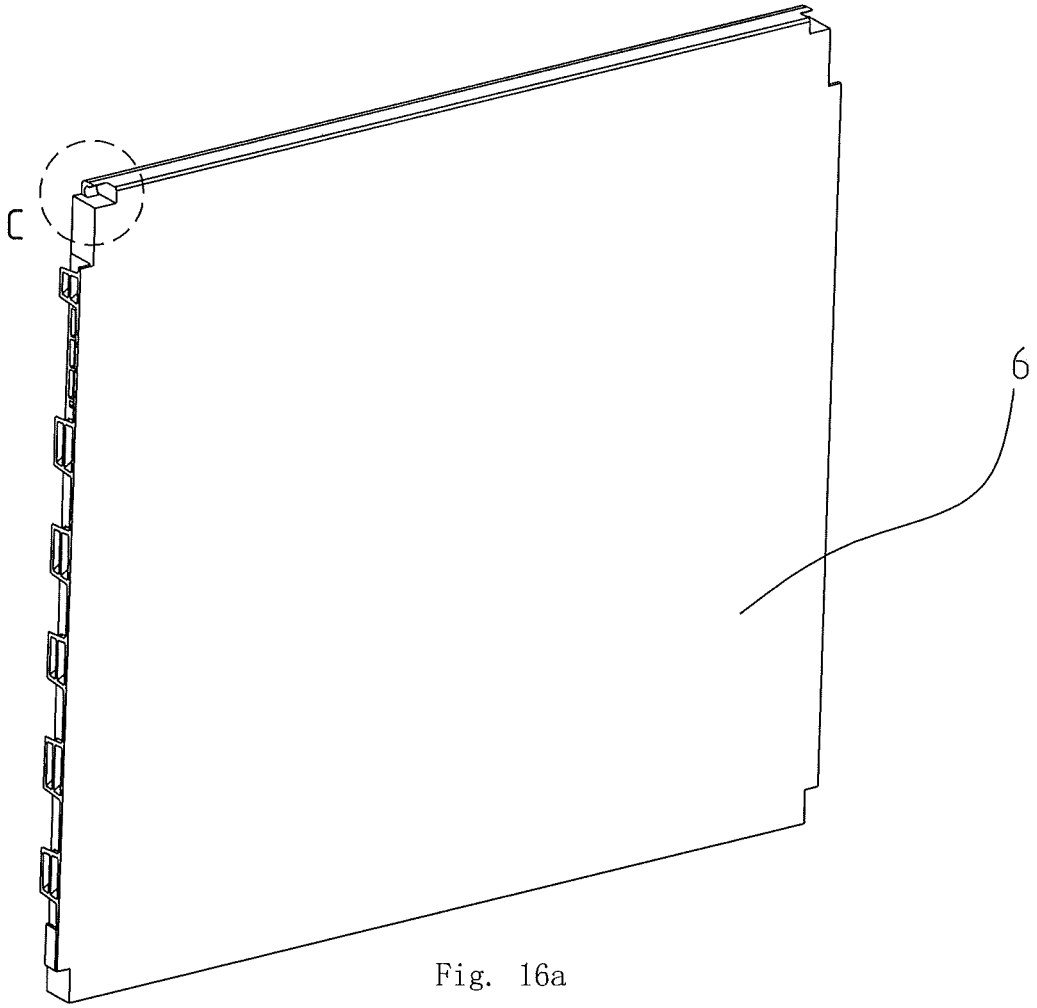
Figure 16B:
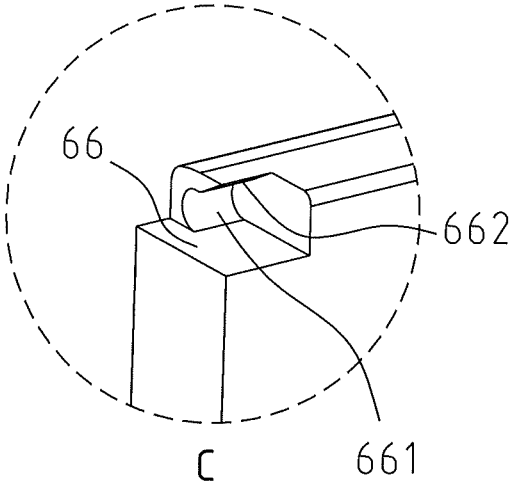

FIG. 14 shows a schematic structural view of the lid in hanging state according to the second embodiment of the present invention;

FIG. 15 shows a perspective structural view of the lid provided with the lid hanging structure according to the third embodiment of the present invention;

FIG. 16*a* shows a perspective view of a side plate provided with the lid hanging structure according to the third embodiment of the present invention;

FIG. 16*b* shows an enlarged perspective view of part C of the side plate in FIG. 16*a;*

Figure 17A:
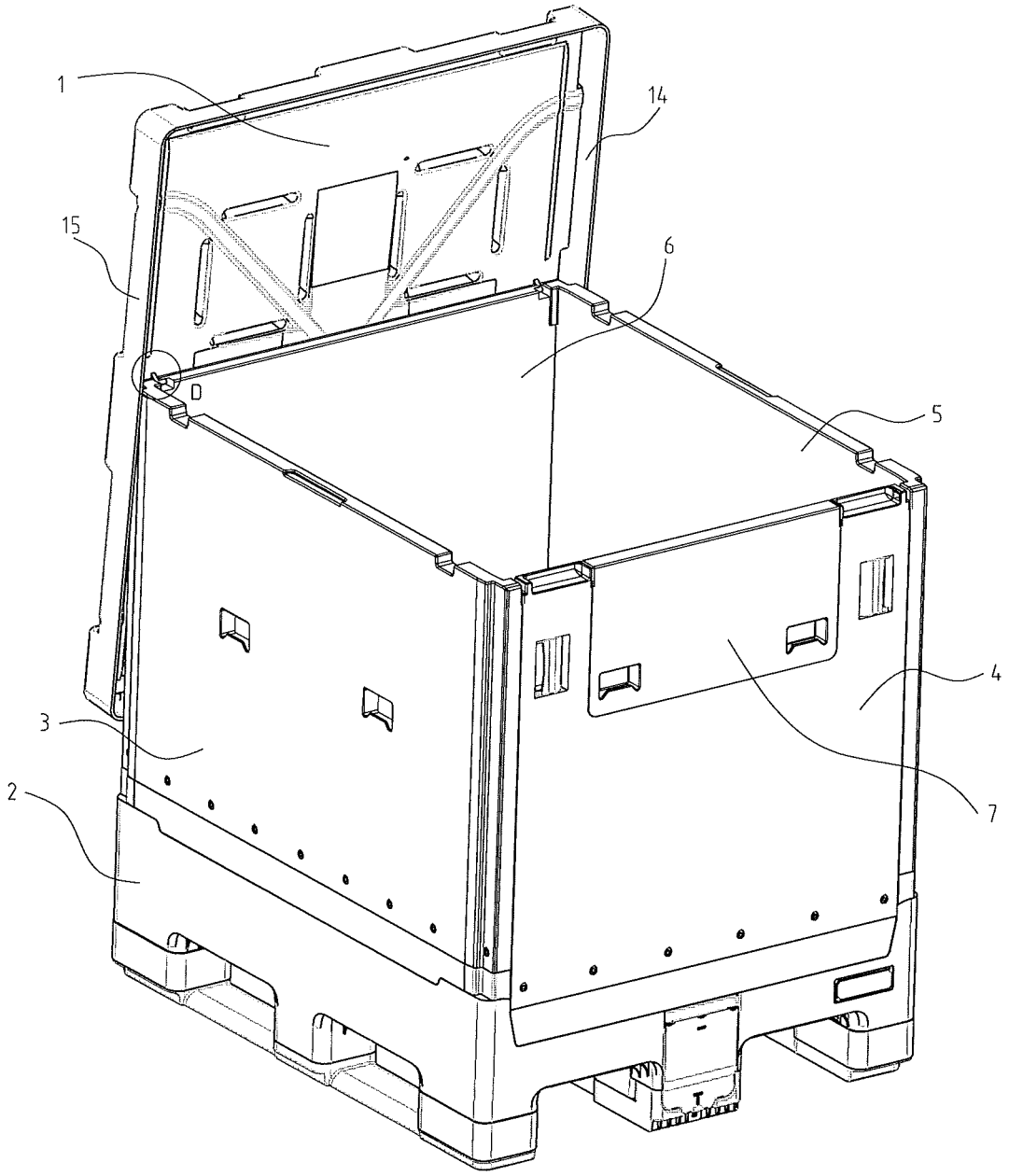
Figure 17B:
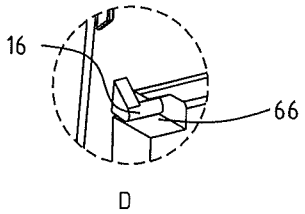
Figure 18:
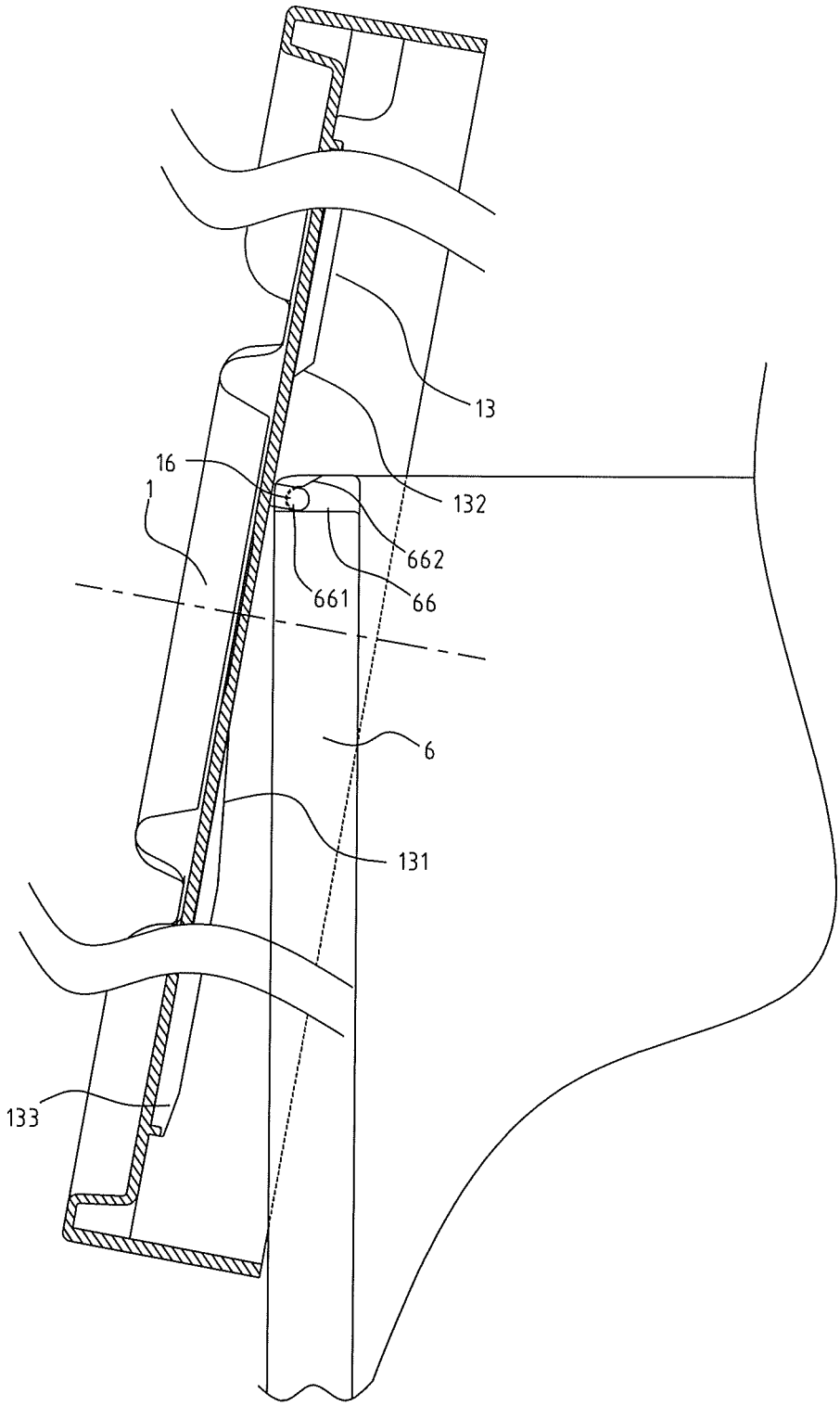

FIG. 17*a* shows a turnover container provided with the lid hanging structure according to the third embodiment of the present invention;

FIG. 17*b* shows an enlarged perspective view of hanging part D in FIG. 17*a*; and FIG. 18 shows a schematic structural view of the lid in hanging state according to the third embodiment of present invention.

DETAILED DESCRIPTION

Hereinafter, preferred embodiments of the present invention will be described in detail with reference to the drawings so that the purposes, features and advantages of the present invention will be understood more clearly. It should be understood that the embodiments shown in the drawings are not to limit the scope of the invention, but merely to illustrate the true spirit of the technical solution in the present invention. It should be noted, the terms "upper", "lower", "left", "right", "front", and "rear" refer to orientations of the components and its specific configurations shown in the drawings, which are not intended to limit their orientations in practical applications.

Figure 1:
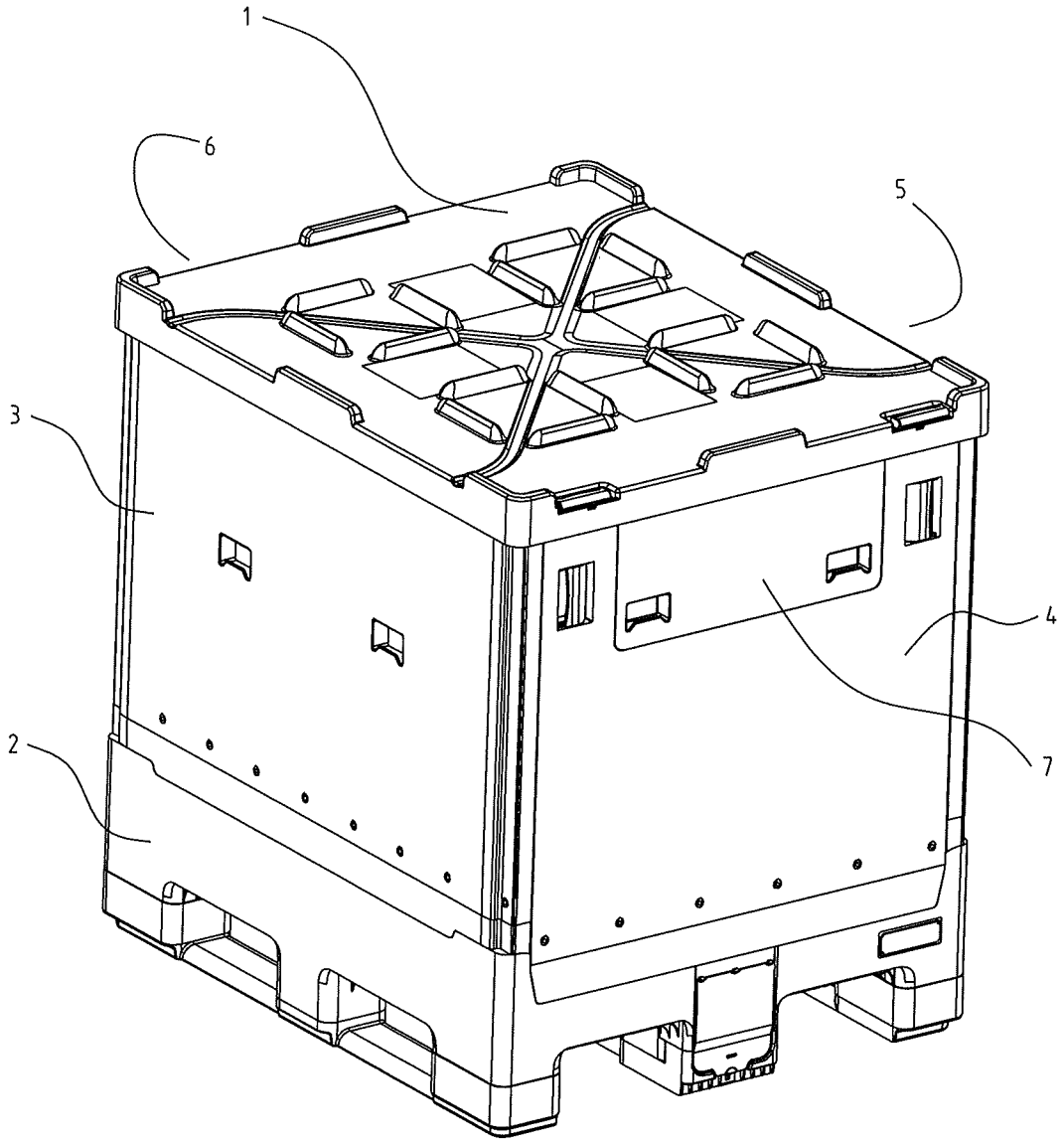
FIG. 1 is a perspective structural view of a general large container.

FIG. 1 shows a general structure of a large container including a lid 1, a base 2, side plates 3,4,5,6 and a small door 7. When the lid 1 is placed on the side plates, the edgeguard around the lid will contact (surround) the outer surfaces of side plates 3,4,5,6 so as to improve the strength of the entire container. A large container generally refers to a container which has a volume of 250 L or more.

Figure 2:
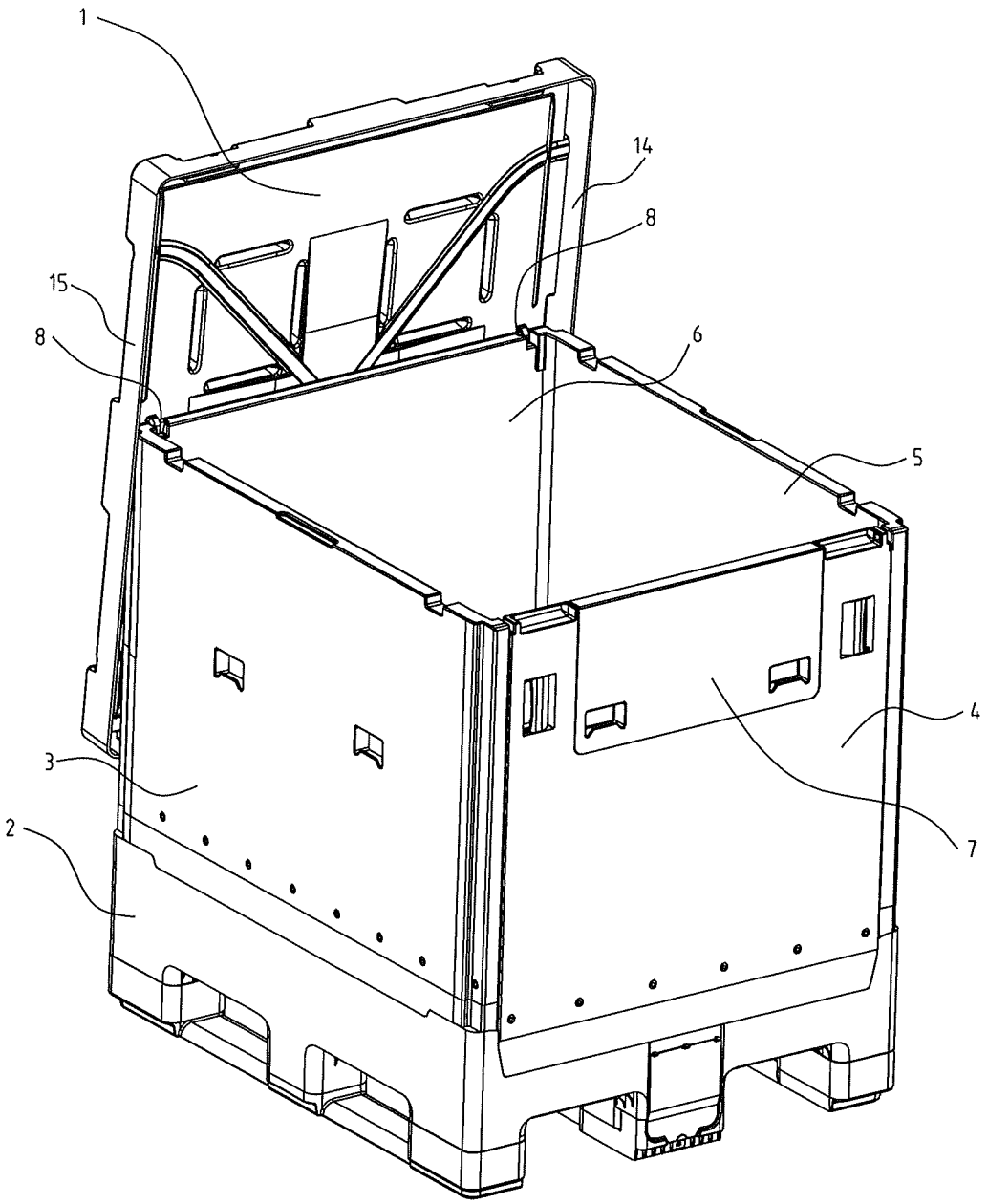
FIG. 2 shows a perspective structural view of a container provided with a lid hanging structure according to the first embodiment of the present invention.

FIG. 2 shows the container provided with the lid hanging structure of the present invention with the lid 1 being hung on the side plate 6. The lid hanging structure includes a bearing pin and a hanging slot (or a hanging hook). The lid 1 can slid on the side plates using the bearing pin so as to open or close the container. Further, the bearing pin may be engaged with the hanging slot (or the hanging hook) so as to hang the lid on the side plates. Wherein the bearing pin can be provided on the lid or on the side plates, or installed on the side plates as a separate member when used. The hanging slot can be provided on the side plates or on the lid, which will be described in more detail hereinafter. It should be noted that, at least one part of the edgeguards 14, 15 of the lid 1 will contact or be close to the outer surfaces of the side plates when the lid 1 is hung on the side plate 6 or slides along the container. Therefore, the configuration of the edgeguards 14, 15 and the side plates 3, 5 will limit the range of the shaking of the lid 1 when the lid 1 slides along the container, so that the lid 1 can slide steadily.

FIG. 3*a*-5*b* show schematic views of the lid hanging structure of a large container according to the first embodiment of the present invention. As shown in FIG. 3*a*-5*b*, the lid hanging structure includes a hanging slot provided on the lid 1, a hanging member 8 as a separate member, and a mating structure provided on a side plate engaging with the lid 1, wherein the mating structure enable the lid 1 and the hanging member 8 to be engaged so as to open or close the lid or hang the lid on the side plates.

Hereinafter, the lid 1, the mating structures provided on the side plate 6, the hanging member 8 and the engagement among them will be described in further detail. FIGS. 3*a*-3*c* show the structure of the lid 1 according to the embodiment. As shown in FIGS. 3*b* and 3*c*, a groove 12 is provided on the left end of the lid 1. A slope 122 is provided at outer side of the groove 12 and a dimple 121 is provided inside the groove 12, wherein an arced contour is provided on the bottom of the dimple 121. A hanging slot 11 is provided on the bottom of the lid 1 near the middle of one edge of the lid and slightly close to right end thereof. A pit 112 is provided in the hanging slot 11 and the mouth of the pit 112 is provided with a slop 111. Further, a rib 13, which is provided on the bottom of the lid 1 and close to the edgeguard, is cut off at the left and right end of the hanging slot so as to forming slopes 131, 132 respectively. In addition, a slope 133 is further provided on the left end of the rib 13.

FIG. 4 is a perspective view of the hanging member 8 with a torsional spring 9 thereon. The hanging member 8 comprises a rotation pin 83, a bearing pin 81, a position limiting pin 82 and a position limiting pin 84, wherein the position limiting pin 84 is further provided with a projection 841. The function of the projection 841 will be described in detail in the following. The torsional spring 9 is installed on the rotation pin 83.

FIG. 5 is a partial side view of the side plate 6, which has two pits 61 on both ends of its upper portion, wherein a circular hole 63 and a special-shaped through-hole 64 with a special arced contour 641 are provided at each pit 61. A stopping edge 65 is provided on the left of the circular hole 63. When mounting the locking member 8 to the side plate 6, the rotation pin 83 is inserted partly into the circular hole 63 firstly and the projection 841 of the position limiting pin 84 is aligned with the arced contour, then the locking member 8 can be completely mounted. After installation of the locking member 8, the position limiting pin 82 is located in the position limiting hole 62. The locking member 8 will lean against the stopping edge 65 since the torsional spring 9 will applied a counterclockwise torque to the locking member 8 continually. Now, the locking member will not able to be released due to the deviation of the arced contour 641 from the projection 841. The locking member can be released only in the case that the projection 841 of the position limiting 84 is aligned with the arced contour 641.

FIG. 6*a*-6*c* shows the process of the hanging member 8 entering the groove 12 when the lid 1 is placed on the side plates from directly above the side plates. The slope 122 will contact with the bearing pin 81 of the hanging member 8 firstly, and the hanging member 8 will be forced to rotate an angle clockwise around its rotation pin 83 due to the pressure applied by the slope 122, which makes the bearing pin 81 to leave the location under the groove 12. The bearing pin 81 faces exactly to the dimple 121 of the groove 12 when the lid 1 is in place. Then, the hanging member 8 will rotate counterclockwise around the rotation pin 83 due to the restore of the torsional spring 9, so that the bearing pin 81 enters into the dimple 121, thereby limiting the upward movement of the lid 1.

Figure 7:
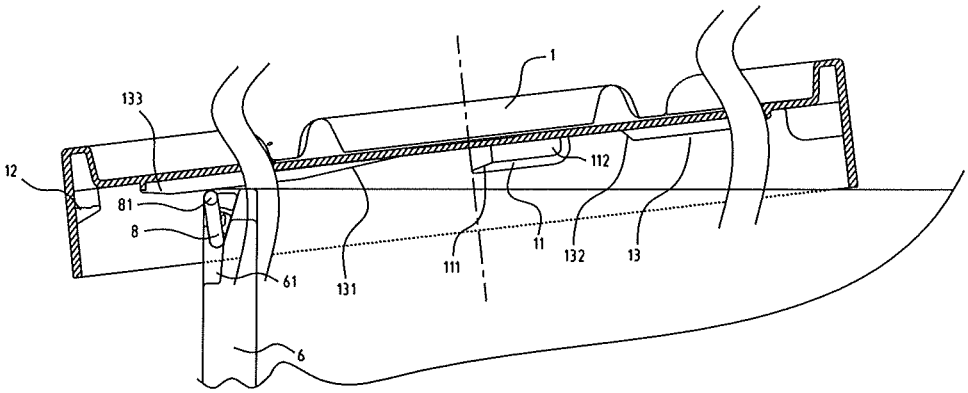
Figure 8:
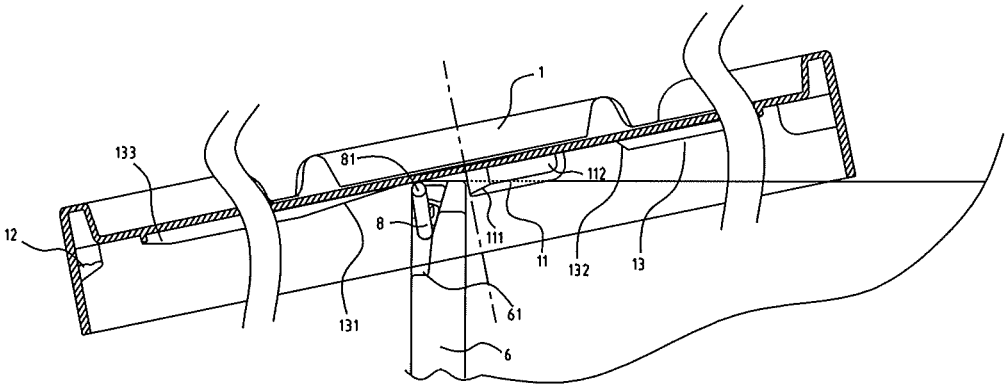

FIGS. 7-10 show the process that the lid 1 moves from the using state to the hanging state. When the lid 1 is opened by a distance from its left side, i.e. from the side plate 4, the lid 1 rotates by a certain angle around a position where the lid 1 contacts with the left and upper portion of the side plate 6. Then, as shown in FIG. 7, the bearing pin 81 of the hanging member 8 will be released from the groove 12 when continuing to push the lid 1 forward. The position where the bearing pin 81 contacts the lid 1 is changed from the lid itself to the rib 18 by the slope 133 provided on the rib 13, so as to reduce friction during the process of sliding of the lid. And the right side of the lid 1 needn't to be lifted up by hand through contacting the lower portion of the edgeguard with the upper portion of the side plates 3, 5. The lid will slid to a position where the slope 131 will not contact with the bearing pin 81, as shown in FIG. 8. Then, the lid 1 itself will contact with the upper portion of the right end of the side plate 6 and the pit 112 is ready to accommodate the bearing pin 81.

Figure 9:
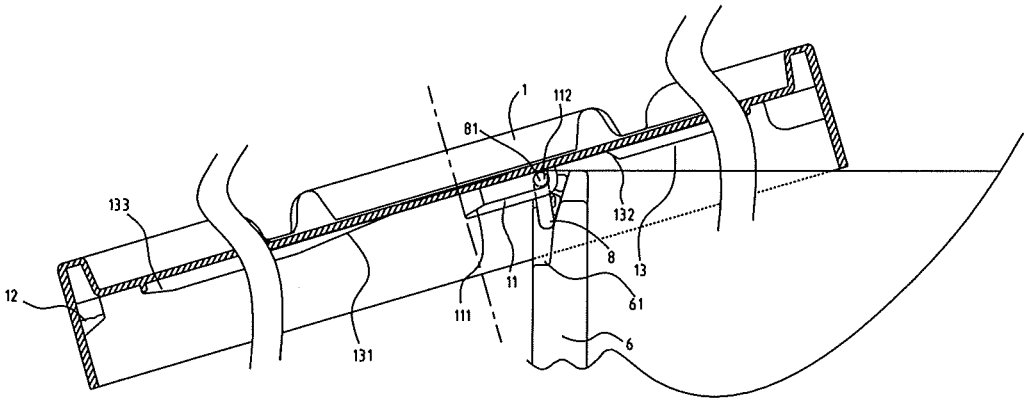
Figure 10:
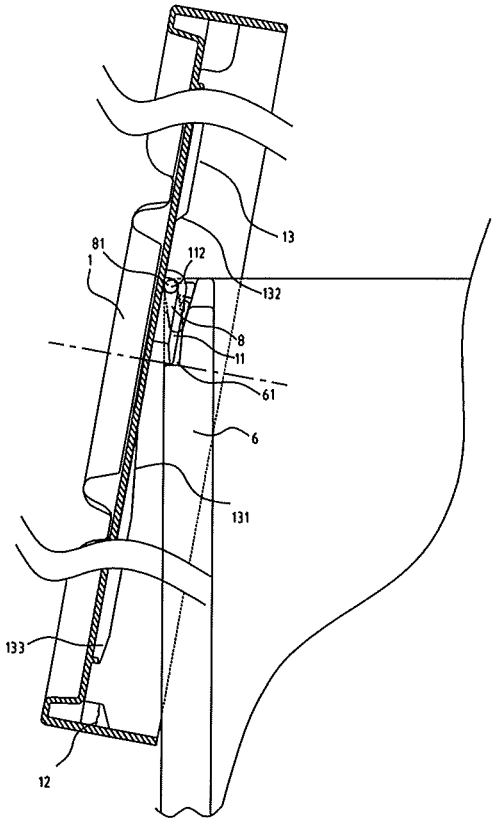

As shown in FIG. 9, the bearing pin 81 will sliding into the pit 112 of the hanging slot 11 easily due to the guide of the slope 111 when pushing the lid 1 forward continuously. The lid 1 can't move forward any further at the moment since the centre of gravity of the lid 1 has already arrived at the outside of the container and there is a trend that the lid 1 will rotate downward. As shown in FIG. 10, the lid 1 will rotate outward around the bearing 81. When the lower part of the left edgeguard of the lid 1 contacts the side plate 6, the lid 1 can't move anymore so that the lid is hung on the side plate 6. The pit 61 of the side plate 6 will accommodate the hanging slot 11 provided on the lid 1.

Figure 11:
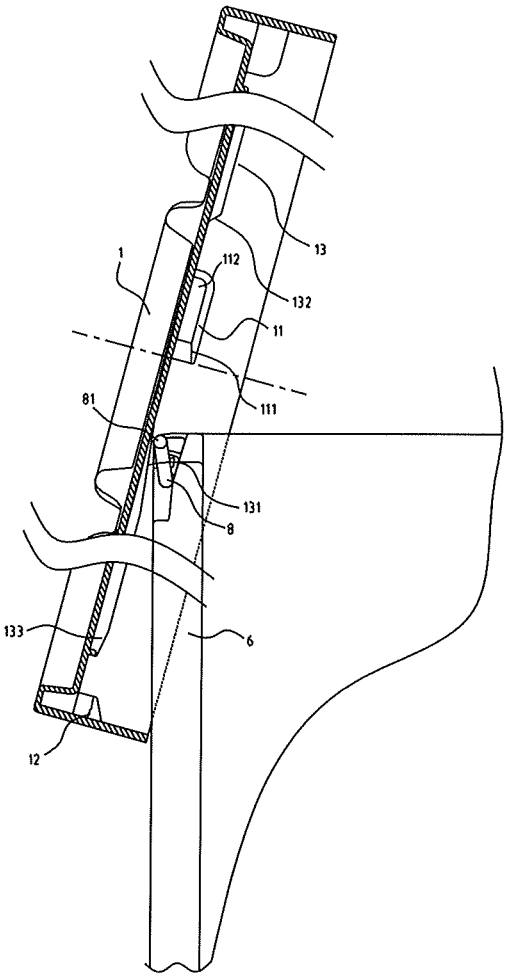

The lid 1 can be removed from the side plates through being opened and moved by a distance. The lid 1 can also be removed from the side plates in the hanging state. As shown in FIG. 11, when the lid 1 is in the hanging state, the bearing 81 will leave the pit 112 when lifting the lid 1 upward, so as to remove the lid 1 from the side plates.

Further, as compared to the above embodiments, there is a more simple way in the second embodiment. As shown in FIGS. 12-14, if the lid 1 is provided with a specific structure for locking to the upper of the side plate 6 to limit the upward movement of the lid 1 when the lid 1 is in use, i.e. the lid is placed on the side plates, the pits 12 can be cancelled and the hanging member 8 is simplified as a bearing pin 66 provided on the side plate 6 or installed on the plate 6 as a separate pin.

It can be understood that in the above two embodiments, the bearing pin can be installed on the side plates as a separate member or as a part of the side plate (as shown in the second embodiment) when the bearing pin is connected to a side plate. The bearing pin may have another function, such as locking function described in the first embodiment when the lid is in use, if the bearing pin is a separate member.

FIG. 15-18 show a lid hanging structure according to the third embodiment. The difference between the third embodiment and the second embodiment is that, a bearing pin 16 of the lid hanging structure is provided on the bottom of the lid 1 near the middle of one edge of the lid and slightly close to right end thereof as a part of the lid 1. As shown in FIG. 15, a projection is provided between the ribs 13 provided on the lid 1 and the bearing pin 16 is provided on a side surface of the projection.

As shown in FIGS. 16*a* and 16*b*, two hanging slot 66 are provided on both ends of the upper portion of the side plate 6 respectively. A pit 661 facing the left is provided in the hanging slot 66 and a slope 662 is provided on the upper wall of the pit 661. The slope 662 will guide the bearing pin 16 into the pit 661 when the lid is opened and slides forward. The lid 1 may be slightly rotated toward the inside and then pushed back by a distance so as to be disengaged from the side plates and removed.

Although all above embodiments are different from each other, the same is that, the bearing pin is not always in the hanging slot. Only in the hanging position or being close to the hanging position, the bearing pin is connected to the hanging slot. The advantage is that the lid can be removed from the side plates easily. That is to say, the lid can be removed directly when not in use or in the hanging state, and can be removed by simple operation in the hanging state, so as to reduce the amount of labor, and the structure is simple and the cost is low.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

What is claimed is:

1. A container assembly having a hanging structure for a lid, comprising a container and the lid, the container comprising:

a base and side plates, the lid being removable and detachable, wherein the hanging structure includes hanging members and hanging slots, the hanging members are engaged with the hanging slots when the lid is hung on the side plates and the hanging members are disengaged with the hanging slots when the lid is removed or detached from the side plates, and wherein the lid is slidable on the side plates so that the hanging members are movable away from or toward the hanging slots, and the hanging members are connected to the hanging slots only in a hanging position, the lid having edgeguards, at least one part of the edgeguards contacts outer surfaces of the side plates when the lid is hung on one of the side plates or slides along the side plates; and the hanging slots are provided on a bottom of the lid and located on a middle portion of one edge of the lid and the hanging members are provided on both ends of an upper portion of the side plates, wherein the hanging members are bearing pins provided on the side plates and the lid can slide along the side plates and be hung on the side plates through the engagement of the bearing pins and the hanging slots.

2. The container assembly as claimed in claim 1, wherein pits are provided on both ends of an upper portion of the side plates respectively, and the bearing pins are projected from side walls of the pits respectively, wherein the bearing pins will enter into the hanging slots after the lid sliding by a distance along the side plates so that the lid can be hung on the side plates.

3. The container assembly as claimed in claim 1, wherein ribs are provided on the lid so as to reduce friction during a process of the sliding of the lid, and the slots are provided with a guide slope so as to guide the bearing pins into the hanging slots.

4. A container assembly having a hanging structure for a lid, comprising a container and the lid, the container comprising:

a base and side plates, the lid being removable and detachable, wherein the hanging structure includes hanging members and hanging slots, the hanging members are engaged with the hanging slots when the lid is hung on the side plates and the hanging members are disengaged with the hanging slots when the lid is removed or detached from the side plates, and wherein the lid is slidable on the side plates so that the hanging members are movable away from or toward the hanging slots, and the hanging members are connected to the hanging slots only in a hanging position, the lid having edgeguards, at least one part of the edgeguards contacts outer surfaces of the side plates when the lid is hung on one of the side plates or slides along the side plates; and the hanging members are provided on a bottom of the lid and located on a middle portion of one edge of the lid and the hanging slots are provided on the side plates, wherein the hanging members are bearing pins provided on the lid and the hanging slots include a pit and a guide slope and are provided on both ends of an upper portion of the side plates respectively, wherein the bearing pins will enter into the pits through the guide slope when the lid slides on the side plates.

5. The container assembly as claimed in claim 4, wherein ribs are provided on the lid so as to reduce friction during the process of the sliding of the lid.

6. A container assembly having a hanging structure for a lid, comprising a container and the lid, the container comprising:

a base and side plates, the lid being removable and detachable, wherein the hanging structure includes hanging members and hanging slots, the hanging members are engaged with the hanging slots when the lid is hung on the side plates and the hanging members are disengaged with the hanging slots when the lid is removed or detached from the lid from the side plates, and wherein the lid is slidable on the side plates so that the hanging members are movable away from or toward the hanging slots, and the hanging members are connected to the hanging slots only in a hanging position, the lid having edgeguards, at least one part of the edgeguards contacts outer surfaces of the side plates when the lid is hung on one of the side plates or slides along the side plates; and the hanging members are separate members which will be installed on both ends of one of the side plates when in use, and the hanging slots are provided on a bottom of the lid and located on a middle portion of one edge of the lid, wherein the hanging slots are provided on the lid and mating structures for engaging with the hanging members and the lid are provided on the side plates, wherein the mating structures enable the lid to engage with the hanging members so as to open or close the lid or hang the lid on the side plates, wherein the hanging members comprise a rotation pin, a bearing pin, and two position limiting pins, wherein one of the position limiting pins is further provided with a projection and a torsional spring is provided on the bearing member;

the mating structure comprises pits on both ends of upper portion of the side plates, wherein a circular hole, a special-shaped through-hole with a special arced contour, and a position limiting hole are provided at each pit; wherein the rotation pin is inserted into the circular hole and the two position limiting pins are inserted into the circular hole and the special-shaped through-hole respectively so as to keep the hanging member on the mating structure when the bearing pins are installed on the side plates; and the bearing pin will be engaged or disengaged with the hanging slots so as to hang or remove the lid.

* * * * *